US007911399B2

(12) United States Patent
Yang et al.

(10) Patent No.: US 7,911,399 B2
(45) Date of Patent: Mar. 22, 2011

(54) ANTENNA ASSEMBLY

(75) Inventors: Jia-Jia Yang, Kunshan (CN); Dao-Yuan Chen, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 411 days.

(21) Appl. No.: 12/150,359

(22) Filed: Apr. 28, 2008

(65) Prior Publication Data

US 2008/0266200 A1 Oct. 30, 2008

(30) Foreign Application Priority Data

Apr. 27, 2007 (CN) ..... 2007 2 0037201

(51) Int. Cl.
*H01Q 1/24* (2006.01)
*H01Q 1/42* (2006.01)

(52) U.S. Cl. ..... 343/702; 343/872

(58) Field of Classification Search ..... 343/872, 343/702

See application file for complete search history.

(56) References Cited

U.S. PATENT DOCUMENTS

| | | | | |
|---|---|---|---|---|
| 6,903,695 | B2 * | 6/2005 | Sjoblom et al. | 343/702 |
| 6,972,721 | B2 * | 12/2005 | Park | 343/702 |
| 7,170,452 | B2 * | 1/2007 | Yang | 343/702 |
| 7,292,194 | B2 * | 11/2007 | Tai et al. | 343/702 |
| 7,499,000 | B2 * | 3/2009 | Chan et al. | 343/872 |

* cited by examiner

*Primary Examiner* — Hoang V Nguyen
(74) *Attorney, Agent, or Firm* — Wei Te Chung; Andrew C. Cheng; Ming Chieh Chang

(57) ABSTRACT

An antenna assembly assembled in an electric device includes an inner antenna comprising a planar radiating element, a cover fixing the antenna on the electric device and comprising at least one protrusion to fix the radiating element.

18 Claims, 3 Drawing Sheets

ANTENNA ASSEMBLY

BACKGROUND OF THE INVENTION

1. Field of the Invention

The present invention relates generally to an antenna assembly, and more particularly to an antenna assembly assembled in an electronic device, such as a notebook.

2. Description of the Prior Art

Since the wireless communication technology of using electromagnetic wave to transmit signals has the effect of remote device transmission without cable connection, and further has the mobility advantage, therefore the technology is widely applied to various products, such as moveable phones, notebook computers, intellectual home appliance with wireless communication features. Because these devices use electromagnetic wave to transmit signals, the antenna used to receive electromagnetic wave also becomes a necessity in the application of the wireless communication technology. For adapting to the more and more beautiful electric devices, the antenna is always assembled in the inside space of the electric devices. To support antennas well, supporting sets are introduced to fix antennas. U.S. Pat. No. 6,903,695 discloses an antenna device which is intended for mounting in a casing for an apparatus. As showed in FIG. 1 of this patent, the antenna device includes a radiating element 4 manufactured from a conducting and resilient material, such as metal. A portion of the radiating element 4 is surrounded by a piece of a configurationally stable, non-conducting material, such as plastic 5. The plastic piece 5 is disposed for mounting of the antenna in the inside of the casing, preferably by snap action. However, the plastic piece 5 completely surrounding the radiating element should influence the radiating effect.

Hence, an improved antenna assembly with a moveable antenna is desired to overcome the above-mentioned shortcomings of the existing antennas.

BRIEF SUMMARY OF THE INVENTION

A primary object, therefore, of the present invention is to provide an antenna assembly which is able to fasten a small antenna in the electric device and make the antenna radiating well.

In order to implement the above object and overcomes the above-identified deficiencies in the prior art, the antenna assembly assembled in an electric device comprises an inner antenna comprising a planar radiating element, a cover fixing the antenna on the electric device and comprising at least one protrusion to fix the radiating element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
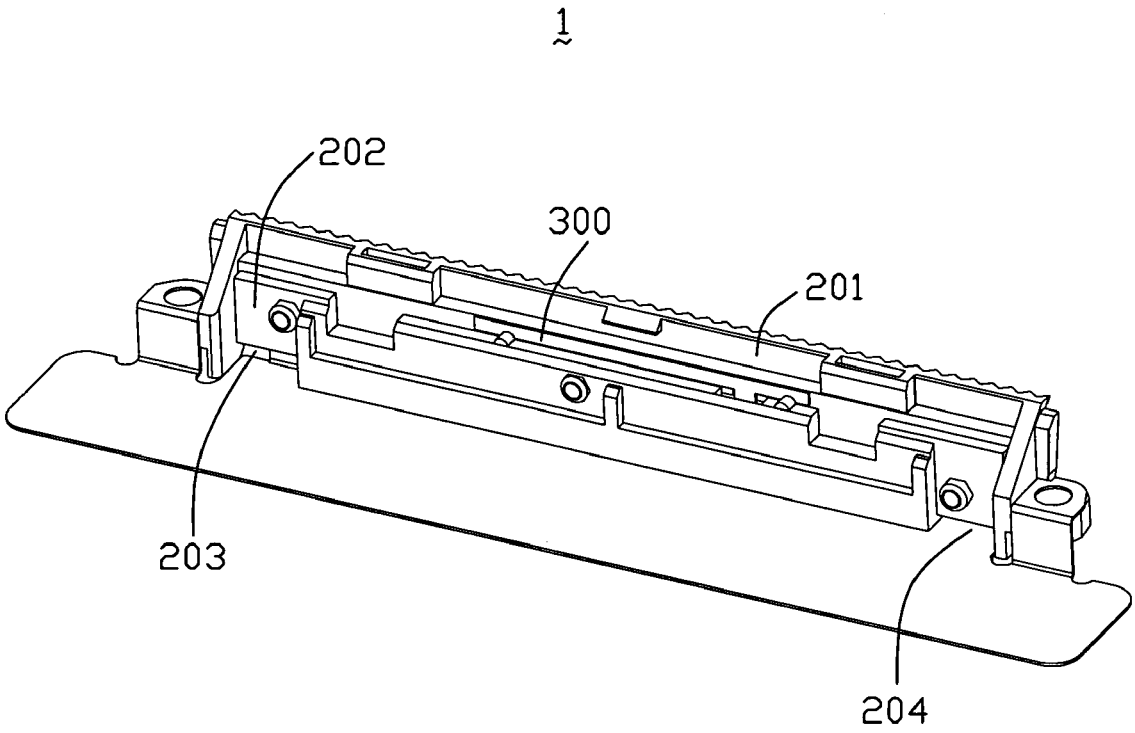
FIG. 1 is a perspective view illustrating a preferred embodiment of an antenna assembly.
Figure 2:
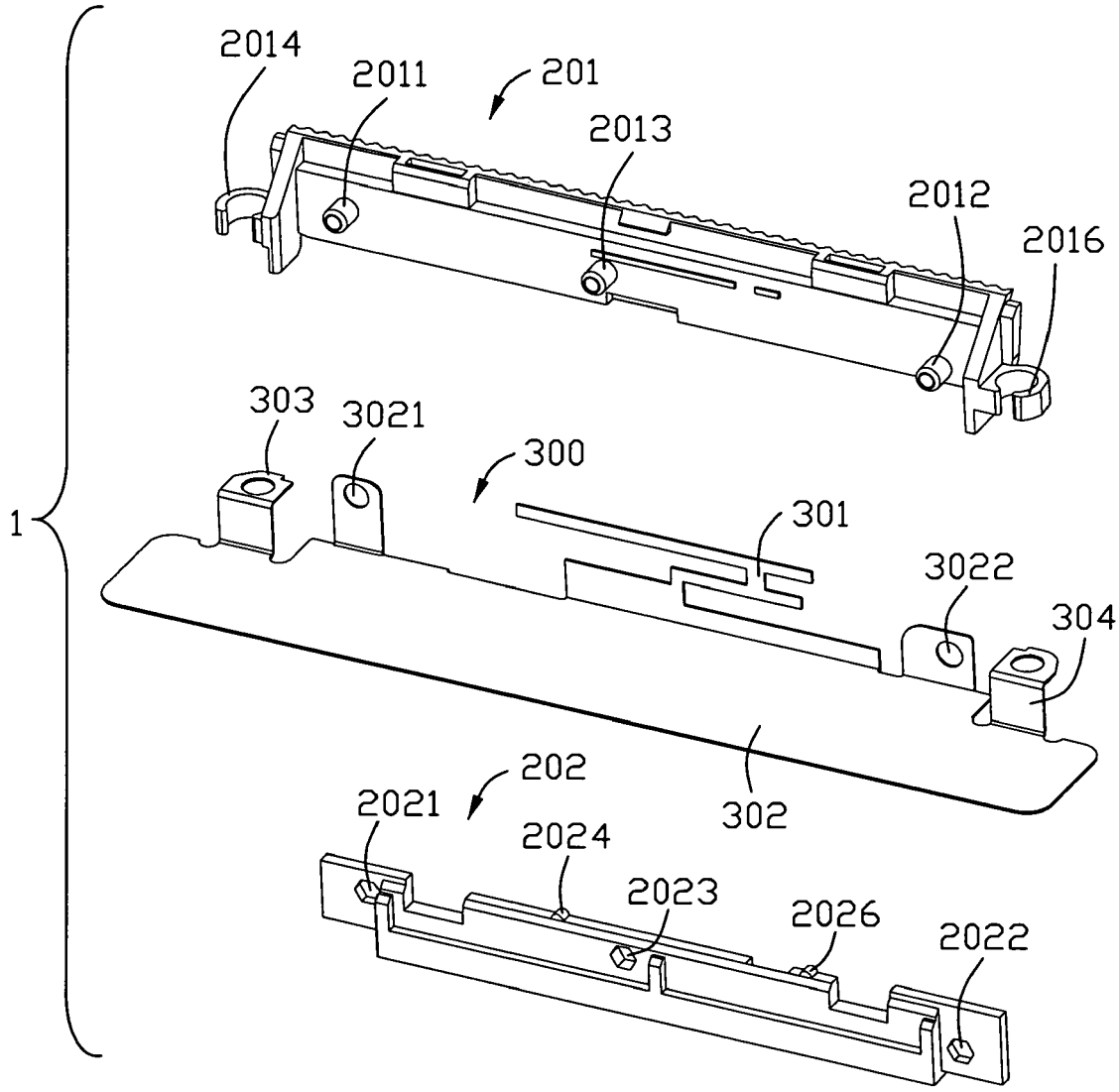
FIG. 2-3 are exploded, perspective views of the FIG. 1, but viewed from different angles.
Figure 3:
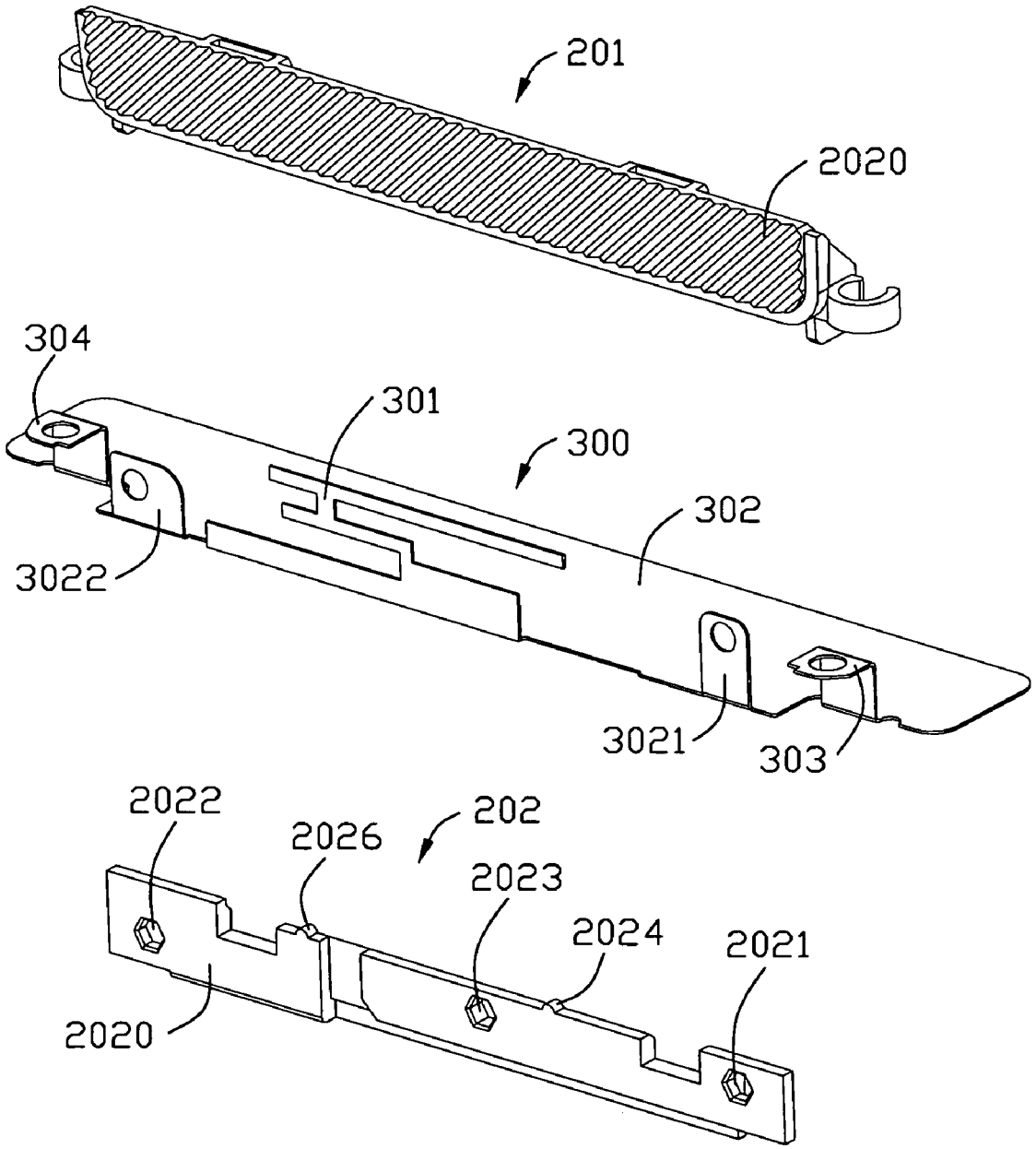

Reference to FIG. 1, an assembled, perspective view of an antenna assembly 1 in accordance with a preferred embodiment of the present invention is shown. Reference to FIGS. 2-3, exploded, perspective views of FIG. 1 are shown, but viewed from different angles.

The antenna assembly 1 is assembled in an electronic device, such as a notebook computer. The antenna assembly comprises a cover 200 made from insulative material and an antenna 300 assembled in the cover.

The antenna 100 is a planar inverted-F antenna, and comprises a radiating element 301 and a grounding element 302 perpendicular to the radiating element 301. A pair of L-shape fixing portions 303, 304 respectively extends from the two opposite ends of the grounding element 302. A pair of reinforcing portions 3021, 3022 respectively extends form one side of the grounding element 302 and is on the two sides of the radiating element 301. Each reinforcing portion 3021, 3022 has a hole. The radiating element 301 is slight and long, which is easy to be bend. Thus, the antenna needs to be assembled in a cover 200 to present shape of the radiating element 301 from changing.

The cover 200 comprises a rear higher first piece 201 and a front lower second piece 202 assembled with the first piece 201 together within the antenna 300 therebetween. The shape of the cover 200 is designed to follow the inner space of the electric device. The first piece 201 comprises an inner face 2010 and an outer face 2020 exposing out the electric device. The first piece 201 comprises some posts 2011, 2012, 2013 inwardly extending from the inner face 2010 to form a group of fixing posts. The posts 2011, 2012 are corresponded to the pair of reinforcing portion 3021, 3022 so that the posts 2011, 2012 should insert into the holes of the reinforcing portion 3021, 3022 when the first piece 201 and the second piece 202 are assembled together. A pair of sub-fixing portions 2014, 2016 respectively extends from the two opposite ends of the first piece 201 and corresponds to the fixing portion 303, 304. The second piece 202 comprises some apertures 2021, 2022, 2023 corresponding to the posts 2011, 2012, 2013, a pair of semicircular protrusions 2024, 2026 extending from the upper surface of the second piece 202. There is a certain distance between the two protrusions 2024, 2026.

In assembly, the antenna 300 is assembled on the first piece 201, wherein the two posts 2011, 2012 respectively insert into the holes of the reinforcing portion 3021, 3022, the post 2013 is below the radiating element 301 and the fixing portions 303, 304 respectively attach onto the fixing portions 2014, 2016. And then, the second piece 202 is assembled on the first piece 201 with the antenna 300 therebetween. The posts 2011, 2012, 2013 respectively interferedly pass through the apertures 2021, 2022, 2023 to fix the second piece 202 on the first piece 201 firmly. And the most important thing is that the two semicircular protrusions 2024, 2026 are respectively attached to the lower portion of the radiating element 301 to make the upper portion of the radiating element 301 not covered by the cover 200. Thus, the antenna 100 achieves better radiating effect than the antenna with a radiating element surrounded by the insulative material.

In other embodiments, the cover 200 and the antenna 300 can be designed to other structures to adapt to different requirements.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. An antenna assembly assembled in an electric device, comprising:

an inner antenna comprising a planar radiating element;

a cover, fixing the antenna on the electric device and comprising at least one protrusion to fix the radiating element, wherein said protrusion is of semicircular shape.

2. The antenna assembly as claimed in claim 1, wherein said cover comprises a first piece and a second piece assembled on the first piece.

3. The antenna assembly as claimed in claim 2, wherein said antenna is between the first piece and the second piece of the cover.

4. The antenna assembly as claimed in claim 2, wherein said antenna attaches to the first piece and the second piece attaches to the antenna except of the radiating element.

5. The antenna assembly as claimed in claim 2, wherein said protrusion upwardly extends form the second piece.

6. The antenna assembly as claimed in claim 2, wherein said first piece comprises some posts forwardly extending therefrom and the second piece comprises some apertures corresponding to the posts.

7. The antenna assembly as claimed in claim 6, wherein said antenna also comprises a grounding element perpendicular to the radiating element and the grounding element extends out the cover.

8. The antenna assembly as claimed in claim 7, wherein said grounding element comprises a pair of reinforcing portions extending from one side of the grounding element and corresponding to the posts of the first piece.

9. The antenna assembly as claimed in claim 7, wherein said first piece comprises a pair of sub-fixing portions respectively extends from the two opposite ends of the first piece.

10. The antenna assembly as claimed in claim 9, wherein said grounding element comprises a pair of L-shape fixing portions corresponding to the sub-fixing portions of the grounding element.

11. An antenna assembly comprising:

an inner metallic antenna defining at least a planar radiating element;

an insulative cover defining two parts supportably sandwiching said planar radiating element therebetween; wherein said antenna further includes a grounding element perpendicular to said radiating element.

12. The antenna assembly as claimed in claim 11, wherein said two parts are assembled together via a post structure.

13. The antenna assembly as claimed in claim 12, wherein said post structure extends through a through hole in of said antenna.

14. The antenna assembly as claimed in claim 13, wherein said through hole is formed in a tab which extends from said grounding element while being parallel to the radiating element.

15. The antenna assembly as claimed in claim 11, wherein the grounding element and the cover further define respective fastening devices for fastening together.

16. The antenna assembly as claimed in claim 11, wherein said radiating element including at least an elongated bar which is covered by one of said two parts on one side thereof and is exposed to an exterior one the other side.

17. The antenna assembly as claimed in claim 16, wherein the other of said two parts defines at least one protrusion cooperating with said one of the two parts to intimately press the radiating element.

18. An antenna assembly assembled in an electric device comprising:

an inner antenna comprising a planar radiating element;

a cover fixing the antenna thereto and comprising at least one protrusion to press only a minor portion of the radiating element while leaving most other portions of said radiating element exposed to an exterior at least on one side of said planar radiating element.

* * * * *